US008963826B2

(12) United States Patent
Oda et al.

(10) Patent No.: US 8,963,826 B2
(45) Date of Patent: Feb. 24, 2015

(54) VIDEO DISPLAY APPARATUS INCLUDING BRIGHTNESS CONTROL BASED ON AMBIENT ILLUMINANCE

(75) Inventors: Eishi Oda, Osaka (JP); Michiaki Takeda, Osaka (JP); Hiroyoshi Kure, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/232,853

(22) PCT Filed: May 10, 2012

(86) PCT No.: PCT/JP2012/061997

§ 371 (c)(1),
(2), (4) Date: Jan. 14, 2014

(87) PCT Pub. No.: WO2013/018410

PCT Pub. Date: Feb. 7, 2013

(65) Prior Publication Data

US 2014/0160180 A1 Jun. 12, 2014

(30) Foreign Application Priority Data

Aug. 3, 2011 (JP) ..... 2011-170122

(51) Int. Cl.
*G09G 3/36* (2006.01)
*G09G 3/32* (2006.01)
*G09G 3/34* (2006.01)

(52) U.S. Cl.
CPC ..... *G09G 3/32* (2013.01); *G09G 3/3426* (2013.01); *G09G 2320/0238* (2013.01);
(Continued)

(58) Field of Classification Search
CPC ..... G09G 3/3426
USPC ..... 345/102
See application file for complete search history.

(56) References Cited

U.S. PATENT DOCUMENTS

2008/0297467 A1* 12/2008 Hsu et al. ..... 345/102
2009/0167658 A1* 7/2009 Yamane et al. ..... 345/102
(Continued)

FOREIGN PATENT DOCUMENTS

JP 2007-140436 A 6/2007
JP 2007-241236 A 9/2007
(Continued)

*Primary Examiner* — Adam J Snyder
(74) *Attorney, Agent, or Firm* — Birch, Stewart, Kolasch & Birch, LLP

(57) ABSTRACT

Light leakage and black float are reduced in dark ambient while a perception of high contrast is achieved when a backlight is divided into a plurality of areas and backlight brightness is controlled depending on a video signal corresponding to each area. An area active control portion (2) divides a video signal into a plurality of areas and outputs a first feature value for each area. An LED control portion (3) acquires a first brightness for each divided area of an LED backlight (5) depending on the first feature value of each area, and acquires a second brightness for each area that is acquired by uniformly multiplying a specific multiplying factor acquired depending on the lighting ratio of the LED backlight (5) with respect to the first brightness within a range where a total value of the LED driving current does not exceed a predetermined permissible current value. When the lighting ratio of the LED backlight (5) is at or below a predetermined value, the second brightness is reduced in accordance with ambient lighting detected by a photosensor (8) to acquire a third brightness.

5 Claims, 7 Drawing Sheets

(52) U.S. Cl.
CPC . *G09G 2320/064* (2013.01); *G09G 2320/0646* (2013.01); *G09G 2330/021* (2013.01); *G09G 2360/144* (2013.01); *G09G 2360/16* (2013.01)
USPC ..... 345/102

(56) References Cited

U.S. PATENT DOCUMENTS

| | | | | |
|---|---|---|---|---|
| 2009/0174636 | A1* | 7/2009 | Kohashikawa et al. | 345/87 |
| 2009/0262063 | A1* | 10/2009 | Fujine et al. | 345/102 |
| 2010/0073276 | A1* | 3/2010 | Koike et al. | 345/102 |
| 2010/0164922 | A1* | 7/2010 | Nose et al. | 345/690 |
| 2010/0225574 | A1* | 9/2010 | Fujiwara et al. | 345/102 |
| 2011/0025728 | A1* | 2/2011 | Baba et al. | 345/102 |
| 2011/0157262 | A1* | 6/2011 | Fujiwara et al. | 345/102 |
| 2011/0205442 | A1 | 8/2011 | Mori et al. | |

FOREIGN PATENT DOCUMENTS

| | | | | |
|---|---|---|---|---|
| JP | 2010-139781 | A | 6/2010 | |
| JP | 2010-152174 | A | 7/2010 | |
| WO | WO 2010041504 | A1 * | 4/2010 | G09G 3/34 |

* cited by examiner

| | | | |
|---|---|---|---|
| A<br>64 | B<br>224 | C<br>160 | D<br>32 |
| E<br>128 | F<br>192 | G<br>192 | H<br>96 |

(A) CONVENTIONAL ART

| | | | |
|---|---|---|---|
| A<br>90 | B<br>220 | C<br>120 | D<br>64 |
| E<br>150 | F<br>110 | G<br>100 | H<br>130 |

(B) CONVENTIONAL ART

VIDEO DISPLAY APPARATUS INCLUDING BRIGHTNESS CONTROL BASED ON AMBIENT ILLUMINANCE

TECHNICAL FIELD

The present invention relates to a video display apparatus and more particularly to a video display apparatus that divides a backlight into areas and that controls the brightness for each of the areas.

BACKGROUND OF THE INVENTION

A technique has conventionally been known for a video display apparatus including a liquid crystal display, etc., to control light emission brightness of a backlight light source depending on the ambient luminance. Such a video display apparatus includes a luminance sensor to detect the ambient luminance, and controls the light emission brightness of the backlight light source depending on the luminance around the video display apparatus detected by the luminance sensor. For example, when the luminance around the liquid crystal display is increased, the visibility not overwhelmed by the ambient light can be acquired by increasing the light emission brightness of the backlight light source following the increase of the luminance (see, e.g., Patent Document 1).

A type of the above video display apparatus is prevailing that uses an LED backlight to illuminate the display panel. The LED backlight has an advantage that local dimming is available. The "local dimming" refers to control of LED light emission for each of areas acquired by dividing the backlight into plural areas, depending on the video signal for each area. For example, the control is enabled such that the light emission of the LED is suppressed for a dark portion in the screen and the light emission of the LED is enhanced for a light portion therein. Thereby, the power consumption of the backlight can be reduced and the contrast of the display screen can be improved.

For example, exemplary control based on the conventional local dimming is depicted in FIG. 9. In this case, the backlight is divided into eight areas and the brightness of the LEDs is controlled depending on the maximal gray scale value of the video signal that corresponds to each of the areas. It is assumed that the maximal gray scale value of the video signal for each area is in the state depicted in (A) of FIG. 9. Each of "A" to "H" denotes an area No., and the number therebeneath is the maximal gray scale value in the area. For example, the brightness of the LED of each area based on the local dimming is depicted in (B) of FIG. 9. The brightness of the LED is controlled for each area depending on the video signal for the area. In this example, the video image is relatively dark in an area where a maximal gray scale value of the video signal is low and, therefore, the brightness of the LEDs is lowered to reduce the black float, to improve the contrast and to save the power consumption of the LEDs. In this case, the maximal brightness in each area is limited to the brightness acquired when all the LEDs of the backlight are lit up at the duty of 100% (for example, 450 cd/m$^2$).

PRIOR ART DOCUMENT

Patent Document

Patent Document 1: Japanese Laid-Open Patent Publication No. 2007-241236

SUMMARY OF THE INVENTION

Problems that the Invention is to Solve

With the conventional local dimming control according to which the backlight is divided into the plural areas and the LED brightness is controlled depending on the video signal that corresponds to each of the areas as above, the maximal brightness in each area is limited to the brightness acquired when all the LEDs of the backlight are lit up at the duty of 100%, and control of the LED brightness is executed depending on the video signal under this limitation. Therefore, limitation is present in improving the contrast by, for example, more specifically brightening a light video image.

In contrast, an approach is known according to which: pulse width modulation (PWM) control is executed such that the electric power does not exceed a specified value; when the area including LEDs to be lit up is small, the electric power is locally supplied; and, thereby, the peak brightness is increased. According to this approach, higher brightness can be acquired compared to the ordinary local dimming. However, on the contrary, the brightness ratio becomes high and, therefore, light leakage tends to become more conspicuous. Therefore, a problem arises that this light leakage is not conspicuous in a place where a luminance around the display is high while the light leakage is conspicuous in a place like a dark room where a luminance around the display is low. Another problem also arises that the increase of the peak brightness causes a what-is-called black float to be conspicuous in an area corresponding to a low gray scale portion (a dark portion) of a video image in a place where a luminance around the display is low.

The present invention was conceived in view of the above circumstances and an object thereof is to provide a video display apparatus that can reduce any light leakage and any black float realizing a high contrast feeling when the ambient luminance is low in the case where the backlight thereof is divided into plural areas and the backlight brightness is controlled depending on the video signal corresponding to each of the areas.

Means for Solving the Problem

To solve the above problems, a first technical means of the present invention is a video display apparatus comprising: a display panel that displays a video signal; a backlight that uses LEDs as a light source illuminating the display panel; a control portion that controls a light emission brightness of the backlight; and an ambient illuminance detecting portion that detects ambient illuminance, the control portion dividing the backlight into a plurality of areas and controlling light emission of the LEDs for each of the divided areas, wherein the control portion acquires a first brightness of the LEDs for each area depending on a first feature value of the video signal of a display area corresponding to the divided area, acquires a second brightness for each area by uniformly multiplying the first brightness by a specific multiplying factor acquired depending on a lighting rate of the backlight or a second feature value of the video signal, within a range where a total value of driving currents of the LEDs is equal to or lower than a predetermined permissible current value, and acquires a third brightness by reducing the second brightness depending on an ambient illuminance detected by the ambient illuminance detecting portion when the lighting rate of the backlight or the second feature value of the video signal is equal to or lower than a predetermined value.

A second technical means is the video display apparatus of the first technical means, wherein the predetermined value is set to reduce maximal brightness for a duty of 100% of brightness corresponding to the lighting rate of the backlight or the second feature value of the video signal.

A third technical means is the video display apparatus of the first technical means, wherein the control portion controls light emission of the LEDs for each area based on the second brightness when the ambient illuminance is higher than a specific value, and controls the light emission of the LEDs for each area based on the third brightness when the ambient illuminance is equal to or lower than a specific value.

A fourth technical means is the video display apparatus of the first technical means, wherein the first feature value is a maximal gray scale value of a video signal in the divided area.

A fifth technical means is the video display apparatus of the first technical means, wherein the second feature value is an APL of the video signal.

Effect of the Invention

According to the present invention: in the case where the backlight is divided into the plural areas and the backlight brightness is controlled depending on the video signal that corresponds to each of the areas, the contrast can be increased by increasing the brightness ratios of the areas and the peak brightness can be increased by locally supplying the electric power when the area for the backlight to be lit up is small, and the peak brightness can be reduced depending on the ambient illuminance of the video display apparatus; and, therefore, any light leakage and any black float can be reduced while realizing a high contrast feeling when the ambient luminance is low.

PREFERRED EMBODIMENT OF THE INVENTION

A preferred embodiment according to a video display apparatus of the present invention will be described with reference to the accompanying drawings.

Figure 1:
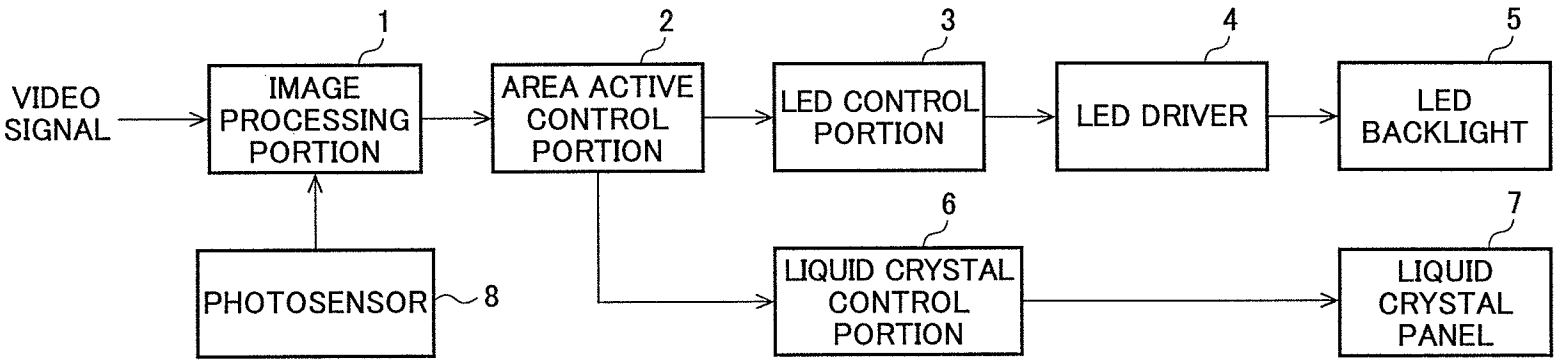
FIG. 1 is a diagram for explaining a configuration example of main portions of a video display apparatus according to the present invention.

FIG. 1 is a diagram for explaining a configuration example of main portions of the video display apparatus according to the present invention. In FIG. 1: "1" denotes an image processing portion; "2" denotes an area active control portion; "3" denotes a LED control portion; "4" denotes a LED driver; "5" denotes a LED backlight; "6" denotes a liquid crystal control portion; "7" denotes a liquid crystal panel; and "8" denotes a photosensor. The video display apparatus is configured to display a video image by executing image processing for an input video signal, and is applicable to a television apparatus, etc. The image processing portion 1 inputs a video signal separated from a broadcast signal or a video signal from an external apparatus, executes a video signal processing similar to the conventional one, for example, arbitrarily executes, IP conversion, noise reduction, a scaling processing, γ adjustment, and white balance adjustment, and adjusts the contrast, the color tone, etc. based on the values set by a user to output the video signal.

The area active control portion 2: divides the video signal into plural areas according to the video signal output from the image processing portion 1; extracts the maximal gray scale value of the video signal for each of the divided areas; and outputs to the LED control portion 3 the extracted maximal gray scale value of the area, as LED data. The area active control portion 2 outputs to the liquid crystal control portion 6 data indicating the gray scale level of each pixel of the liquid crystal as liquid crystal data. In this case, the liquid crystal data and the LED data are output such that the synchronization is maintained between the LED backlight 5 and the liquid crystal panel 7 that are the final outputs.

Though the maximal gray scale value of the video signal for each divided area is employed as the LED data, not only the maximal gray scale value but also another predetermined statistical amount may be employed as the LED data, such as, for example, the average gray scale value of the video signal in the divided area. The maximal gray scale value in the area is generally used as the LED data and the description below will be made assuming that the maximal gray scale value in the divided area is employed.

The LED control portion 3 executes electric power limit control based on the LED data output from the area active control portion 2, and determines a control value used to control the lighting up of each LED of the LED backlight 5. The electric power limit control: is control to cause the brightness of the backlight to be more increased for the area where a brightness needs to be more increased in the display screen and, thereby, to improve the contrast; and causes the light emission brightness of the LEDs to be increased in a range where the total amount of the driving currents of the LEDs lit up in each area does not exceed the total amount of the driving currents necessary when all the LEDs of the backlight are lit up that is the upper limit of the driving currents.

The brightness of the LEDs of the LED backlight 5 can be controlled using the pulse width modulation (PWM) control, the current control, or the combination of these two. In any one of these control methods, the control is executed to cause the LEDs to emit light at a desired brightness. The following example will be described taking an example of duty control using the PWM. The control value output from the LED control portion 3 is a value to control the light emission of the LEDs for each divided area of the area active control portion 2 and, thereby, local dimming is realized. The control portion of the present invention corresponds to the area active control portion 2 and the LED control portion 3. The LED driver 4 controls the light emission of each of the LEDs of the LED backlight 5 according to the control value output from the LED control portion 3. The photosesor 8 is an example of an ambient illuminance detecting portion that detects the ambient illuminance of (that is, the luminance around) the video display apparatus.

The primary object of the present invention is to reduce any light leakage and any black float realizing a high contrast feeling when the ambient luminance is low in the case where the backlight is divided into plural areas and the backlight brightness is controlled depending on a video signal corresponding to each of the areas. For this objective, the LED control portion 3: acquires a first brightness of the LEDs of each area as depicted in (B) of FIG. 9 depending on a first feature value (for example, the maximal gray scale value) of the LED data output from the area active control portion 2, that is, the video signal for the display area corresponding to each divided area; acquires a second brightness for each area acquired by uniformly multiplying the first brightness by a specific multiplying factor acquired depending on the lighting rate (described later) of the LED backlight 5 or a second feature value (for example, the average picture level (APL)) of the video signal, in a range within where the total amount of the driving currents of the LEDs is equal to or smaller than a predetermined permissible current value; and acquires a third brightness by reducing the second brightness depending on the ambient illuminance detected by the photosensor 8 when the lighting rate of the LED backlight 5 or the second feature value of the video signal is equal to or lower/smaller than a predetermined value.

Figure 2:
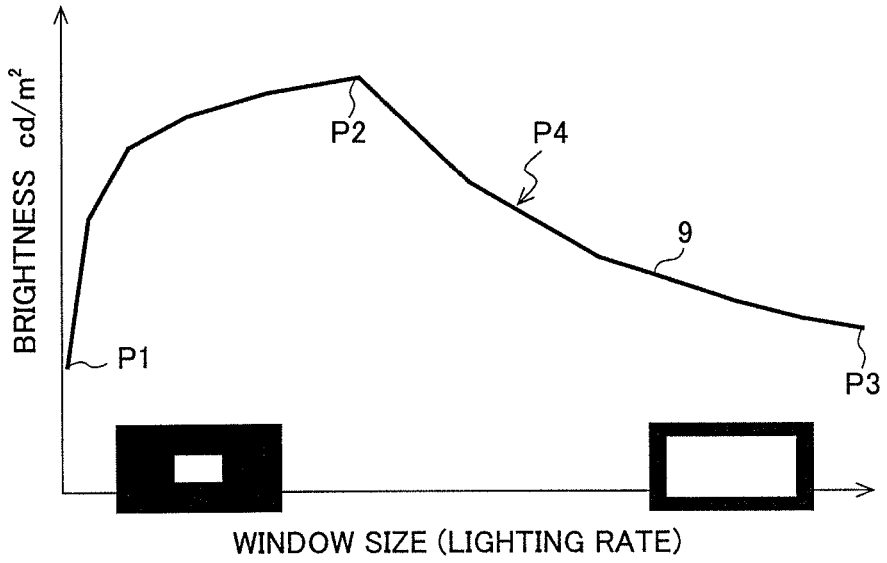
FIG. 2 is a diagram for explaining a setting example of LED brightness set by an LED control portion of the video display apparatus.

FIG. 2 is a diagram for explaining a setting example of the LED brightness set by the LED control portion 3 of the video display apparatus. In FIG. 2, "9" denotes a brightness to lighting rate curve. The LED control portion 3 determines the brightness of the LED backlight 5 based on the relation of FIG. 2. The axis of abscissa represents the lighting rate (the window size) of the LED backlight 5. The "lighting rate" is a rate that determines the average lighting rate of the overall backlight and can be represented by a ratio of the extinction areas to the fully lit up areas (the window area). When no lit up area is present, the lighting rate is zero. The lighting rate is increased as the window of each of the lit up areas becomes larger. The lighting rate is 100% in the fully lit up state. The axis of ordinate represents the brightness of the LEDs in the divided area, represents the brightness of the LEDs in the area capable of taking the maximal brightness, and represents the brightness of the area that includes the window in the screen. The brightness to lighting rate curve 9 is stored in a memory (not depicted) and is referred to based on the lighting rate of the LED backlight 5 acquired from the video signal.

The electric power limit control causes the electric power to light up the LEDs (the total amount of the driving current values) to be constant. Therefore, the electric power capable of being supplied to one of divided areas becomes low as the lighting rate becomes high. An example of the relation between the lighting rate (the window size) and the maximal brightness of the divided area is depicted in FIG. 2. Within a range where the lighting rate is low, the electric power can be concentrated on the small window and, therefore, each of the LEDs can be lit up to the maximal brightness thereof with the duty of 100%. However, within the region (from P1 to P2) where the lighting rage is low and not all the LEDs in one of divided areas can fully be lit up, the brightness for the overall area is low even when the duty of each of the lit up LEDs is set to 100%. In this case, the brightness of the area is the lowest when the lighting rate is zero (the window size is zero), and the window size in the area becomes larger as the lighting rate becomes higher and, therefore, the brightness of the area is also increased. Therefore, it can be seen that the shape of the curve of the brightness to the region from P1 to P2 is varied according to the number of divided pieces of the video signal (the size of the divided area).

When the lighting rate is increased from zero and reaches a lighting rate at which the LEDs in one area can all be lit up (P2), the brightness of the area is the maximum. The duty of each of the LEDs at this time is 100%. When the lighting rate becomes higher than that of P2, the LEDs to be lit up are increased and, therefore, the electric power capable of being supplied to the LEDs is reduced due to the electric power limit control and, therefore, the maximal brightness capable of being taken by the area is gradually reduced. A point P3 indicates the state where all the LEDs for the overall screen are lit up and, in this example, the duty of each of the LEDs is decreased to, for example, 36.5%.

The electric power limit control causes the brightness of the backlight to be more increased for the area needing higher brightness in the display screen to improve the contrast. In this example, the light emission brightness of each of the LEDs is increased at a specific multiplying factor in a range, setting the upper limit of the driving currents to be the total amount thereof necessary when all the LEDs of the backlight are lit up and such that the total amount of the driving currents for the LEDs lit up in each area does not exceed the total amount of the driving currents necessary when all the LEDs of the backlight are lit up.

Figure 3:
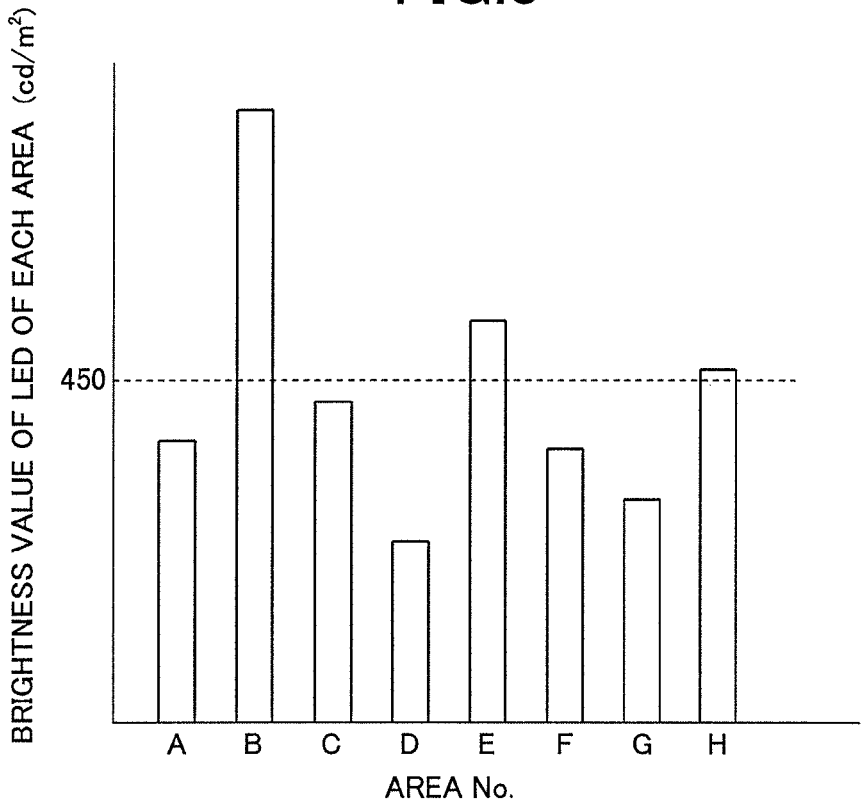
FIG. 3 is a diagram is a diagram for explaining a control example based on local dimming according to an electric power limit control.
Figure 9:
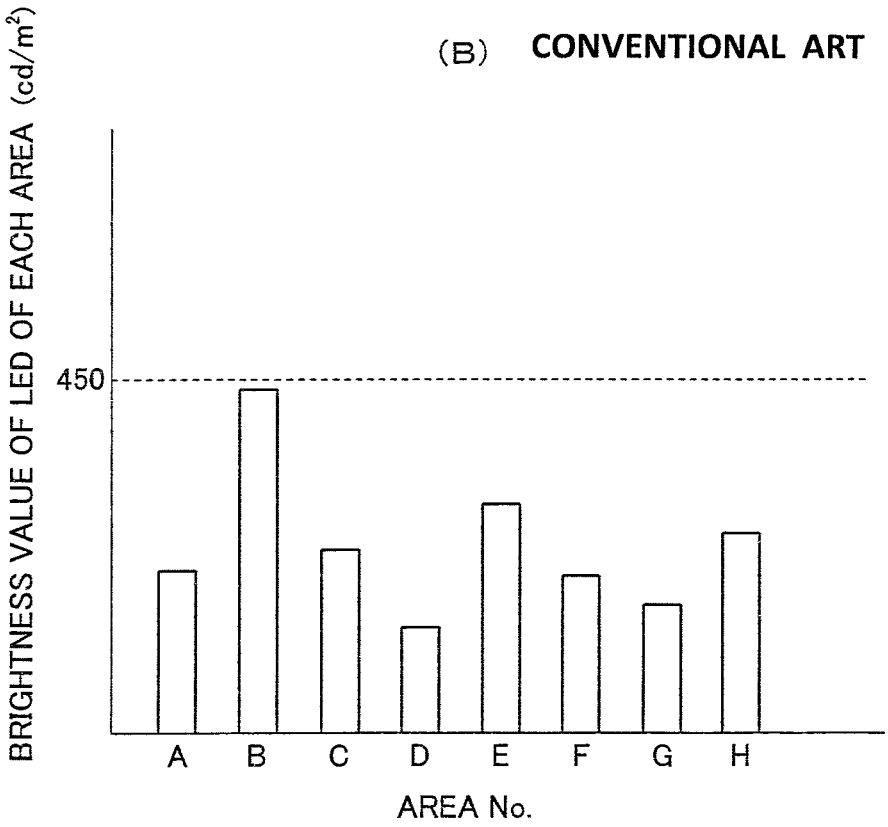
FIG. 9 is a diagram for explaining a conventional control example based on the local dimming.

As depicted in FIG. 3, the brightness is increased to brightness acquired by multiplying the light emission brightness of the LED determined for each area in (B) of FIG. 9 (the first brightness) by the specific multiplying factor ("a"). The condition for this case is "the total amount of the driving current values of the areas" "the total driving current value necessary when all the LEDs are lit up". In this case, in one area, exceeding the brightness (for example, 450 cd/m$^2$) acquired when all the LEDs are lit up is permitted, the driving current is supplied to the LEDs as much as possible as far as the electric power permits, and thereby, the brightness is increased. Executing such control enables actual acquisition of the peak brightness that is twice or three times as high as the original peak.

Figure 4:
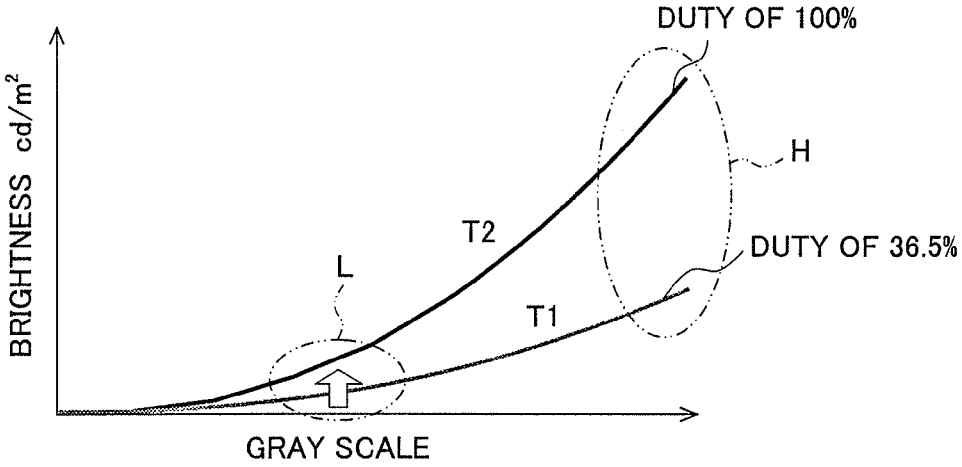
FIG. 4 is a diagram of a state of brightness of a liquid crystal panel acquired when a duty of LED brightness is varied.

FIG. 4 is a diagram of the state of the brightness of the liquid crystal panel acquired when the brightness duty of the LED is varied. The axis of abscissa represents the gray scale level of the video signal and the axis of ordinate represents the brightness value of the liquid crystal panel. For example, when the LED of the LED backlight 5 is controlled with the duty of 36.5%, the gray scale expression of the video signal becomes as indicated by T1. In this case, "the brightness value of the liquid crystal panel"=(the gray scale value)$^{2.2}$ (that is, gamma=2.2). When the LED is controlled with the duty of 100%, the gray scale expression becomes as indicated by T2. The brightness of the LED is increased from 36.5% to 100% that corresponds to about 2.7 times as high as the original brightness and, therefore, the brightness value of the liquid crystal panel is also increased to a value about 2.7 times as high as the original value. In this case, the brightness is increased 2.7 times not only in the area H where an increase of a brilliancy feeling of high brightness is desired, but also in the low gray scale area L. Therefore, though the contrast of the video image is improved, disadvantages such as the light leakage and the black float in low gray scale areas also occur due to the increase of the brightness when the ambient luminance is low.

According to the present invention, the light emission duty of the LED is controlled by the electric power limit control, thereby, the duty is uniformly increased within the range permitted by the electric power to improve the contrast, and the brightness of the LED backlight is reduced depending on the ambient illuminance to suppress the light leakage and the black float that are conspicuous when the ambient luminance is low.

Figures 5, 6:
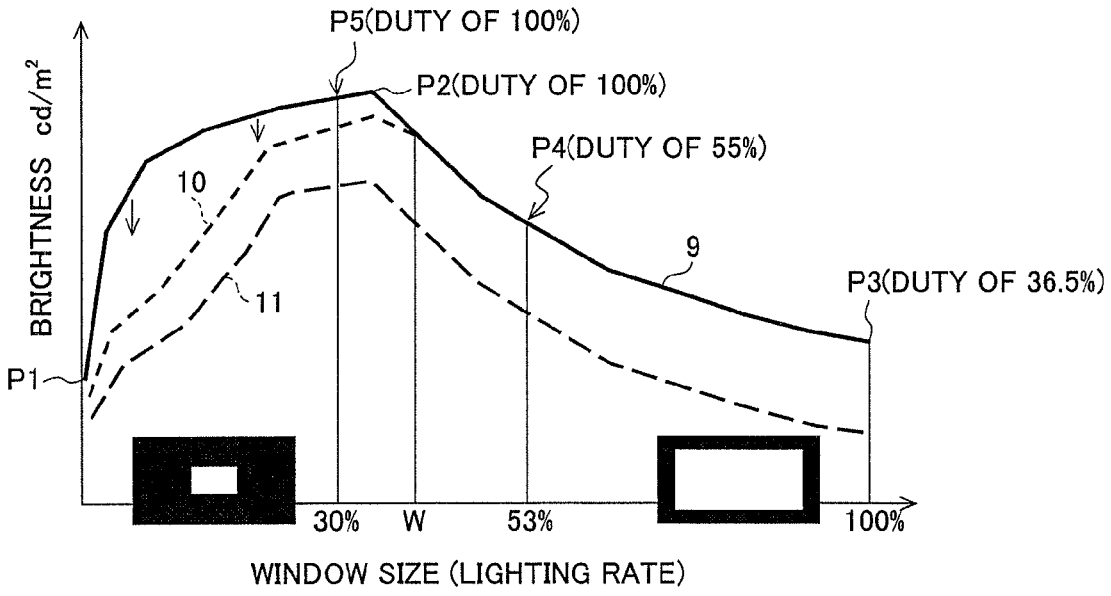
FIG. 5 is a diagram of an example where a display screen is divided into eight pieces.
FIG. 6 is a diagram for explaining a setting example of a brightness to lighting rate curve according to the present invention.

An example of specific processing of each of the area active control portion 2 and the LED control portion 3 according to the present invention will be described. FIG. 5 depicts an example where the display screen is divided into eight pieces. In FIG. 5, divided area Nos. are set to be A to H and the maximal gray scale value of the video signal of each area is depicted. The maximal gray scale value corresponds to the first feature value of the present invention. It is assumed in this example that the first feature value is the maximal gray scale value of each area and, in addition, another statistical value may be used such as the average of the gray scale values in the area. In this example, the maximal gray scale values of the video signals in the eight divided areas are, for example, 64, 224, 160, 32, 128, 192, 192, and 96, and the average of the maximal gray scale values is a value that is 53% of 256 gray scale levels. In this case, in the graph of FIG. 2, this corresponds to a lighting rate (the window size) of 53% at the point P4.

In FIG. 2, it is assumed for the lighting rate of 53% (P4) that the duty is 55% of the LED corresponding to the brightness of the LED backlight 5 in the area capable of taking the maximal brightness. When the lighting rate of the screen is 53%, the electric power limit control enables the brightness of the LED backlight 5 to the brightness corresponding to the duty of 55%. In this case, the duty of 55% corresponds to a duty that is about 1.5 times as high as the duty of 36.5% acquired when all the LEDs are lit up (the lighting rate of 100%). The electric power can be supplied to the lit LEDs such that the brightness about 1.5 times as high as that for the duty of 36.5% is acquired when the lighting rate is 53%, as opposed to the duty of 36.5% of the LED acquired when all the LEDs are lit up.

From the above, the second brightness that is acquired by increasing the peak brightness for each area as depicted in FIG. 3 is acquired by multiplying the light emission brightness of the LED determined for each area in (B) of FIG. 9 (the first brightness) by the specific multiplying factor "a" a that is a=1.5 when the lighting rate is 53% (this multiplying factor "a" is also referred to as "brightness increase ratio" or "duty increase ratio"). In this manner: the PWM control is executed such that the electric power does not exceed the specified value; the electric power is locally supplied when the area to be lit up is small; thereby, the peak brightness is increased; and, thereby, high brightness can be acquired compared to the ordinary local dimming. However, on the contrary, the brightness ratio becomes high and, therefore, the light leakage tends to be more conspicuous. This light leakage is not conspicuous in a place where an ambient luminance is high. However, a problem arises that this light leakage is conspicuous in a place where an ambient luminance is low such as a dark room. Another problem arises that the increase of the peak brightness causes the what-is-called black float to be conspicuous in an area corresponding to the low gray scale portion (the dark portion) of the video image in a place where an ambient luminance is low.

To solve the above problems, according to the present invention: the peak brightness is reduced depending on the ambient illuminance of the video display apparatus and, thereby, the light leakage and the black float can be reduced while realizing a high contrast feeling when the ambient luminance is low. This will be described with reference to FIG. 6. In FIG. 6, the brightness to lighting rate curve 9 is same as that depicted in FIG. 2. A brightness to lighting rate curve 10 is a curve acquired by reducing the brightness (the light emission duty) of the LED backlight 5 when the lighting rate of the LED backlight 5 is equal to or lower than a predetermined value W, from that of the brightness to lighting rate curve 9. The method of determining the predetermined value W is not especially limited, and the predetermined value W may arbitrarily be set by the user. A brightness to lighting rate curve 11 is a curve acquired by reducing the brightness (the light emission duty) for the full lighting rate of the LED backlight 5 from that of the brightness to lighting rate curve 9. In this case, the predetermined value W may be set to the lighting rate of 100%.

When the ambient illuminance detected by the photosensor 8 exceeds a specific value, that is, the ambient luminance is high, the second brightness that is acquired by increasing peak brightness of each area is acquired using the brightness to lighting rate curve 9 as depicted in FIG. 3. When the ambient illuminance detected by the photosensor 8 is equal to or lower than the specific value, that is, the ambient luminance is low, the third brightness whose peak brightness is reduced to be lower than the second brightness using the brightness to lighting rate curve 10 or 11 is acquired. The method of determining the specific value is not especially limited, and the specific value may arbitrarily be set by the user. In this manner, when the ambient illuminance exceeds the specific value, the light emission of the LED backlight 5 is controlled for each area based on the second brightness and, when the ambient illuminance is equal to or lower than the specific value, the light emission of the LED backlight 5 is controlled for each area based on the third brightness acquired by lowering the second brightness.

The case will be described where the third brightness is determined using the brightness to lighting rate curve 10. In FIG. 6, when the lighting rate of the LED backlight 5 acquired from the video signal is equal to or lower than the predetermined value W, a brightness increase ratio (a duty increase ratio) is acquired for the duty of 36.5% (P3) of the LED acquired when all the LEDs are lit up by referring to the brightness to lighting rate curve 9 based on this lighting rate; and the second brightness is determined for each area from the acquired brightness increase ratio and the first brightness. When it is determined that the ambient luminance is low, a brightness decrease ratio (a duty decrease ratio) can be acquired from the brightness to lighting rate curve 9 to the brightness to lighting rate curve 10 by referring to the brightness to lighting rate curve 10 based on the same lighting rate; and the third brightness can be determined for each area from the acquired brightness decrease ratio and the second brightness. The brightness increase and decrease ratios may respectively be represented by a brightness increase amount and a brightness decrease amount. When it is determined that the ambient luminance is high, the second brightness is used as it is.

Specifically, in the example of FIG. 6, in the case where the lighting rate of the LED backlight 5 is 30% that is equal to or lower than the predetermined value W, when the brightness to lighting rate curve 9 is referred to and the duty is 100% (P5) in this case, the brightness increase ratio (the duty increase ratio) for the duty of 36.5% (P3) of the LED acquired when all the LEDs are lit up is about 2.7 and, therefore, the second brightness can be acquired for each area by multiplying the first brightness by 2.7. In the case where it is determined that the ambient luminance is low, when the brightness to lighting rate curve 10 is referred to based on the same lighting rate (30%) and the duty is 80% in this case, the brightness decrease ratio (the duty decrease ratio) for the duty of 100% (P5) is 0.8, and therefore, the third brightness can be acquired for each area by multiplying the second brightness by this 0.8.

Though the brightness decrease ratio (the duty decrease ratio) is acquired based on the brightness to lighting rate curves 9 and 10 in the above example, the brightness increase ratio (the duty increase ratio) may directly be acquired from the brightness to lighting rate curve 10. In the case where it is determined that the ambient luminance is low and the lighting rate of the LED backlight 5 is 30% that is equal to or lower than the predetermined value W, when the brightness to lighting rate curve 10 is referred to without referring to the brightness to lighting rate curve 9 and the duty is 80% in this case, the brightness increase ratio (the duty increase ratio) for the duty of 36.5% (P3) of the LED acquired when all the LEDs are lit up is about 2.2 and, therefore, the third brightness can consequently be acquired that is acquired by reducing the second brightness similarly to the above example, by multiplying the first brightness by 2.2.

The predetermined value W is a set value that is arbitrarily set. However, preferably, the predetermined value W is set such that the maximal brightness is lowered at the time when the duty is 100% at the point P2 on the brightness to lighting rate curve 9 in the brightness corresponding to the lighting rate of the LED backlight 5 of FIG. 6. Specifically, the lighting rate of the LED backlight 5 taking the maximal brightness (P2) for the duty of 100% is caused to be included in the range of the lighting rate that is equal to or lower than the predetermined value W. Thereby, reduction of the maximal brightness for the duty of 100% becomes possible and, therefore, when the ambient luminance is low, the screen brightness can be reduced, and any light leakage and any black float can more effectively be reduced while maintaining the high contrast.

The case will be described where the third brightness is determined using the brightness to lighting rate curve 11. In this example, when the ambient luminance is low, the control is executed such that the peak brightness is reduced for all the lighting rates of the LED backlight 5 acquired from the video signal. In FIG. 6: the brightness increase ratio (the duty increase ratio) is acquired for the duty of 36.5% (P3) of the LED at the time when all the LEDs are lit up by referring to the brightness to lighting rate curve 9, based on the lighting rate of the LED backlight 5; and the second brightness is determined for each area from the acquired brightness increase ratio and the first brightness. When it is determined that the ambient luminance is low, the brightness decrease ratio (the duty decrease ratio) can be acquired from the brightness to lighting rate curve 9 to the brightness to lighting rate curve 11 by referring to the brightness to lighting rate curve 11 based on the same lighting rate; and the third brightness can be determined for each area from the acquired brightness decrease ratio and the second brightness. The brightness increase and decrease ratios may respectively be represented by the brightness increase amount and the brightness decrease amount. When it is determined that the ambient luminance is high, the second brightness is used as it is.

Specifically, in the example of FIG. 6, in the case where the lighting rate of the LED backlight 5 is 53%, when the brightness to lighting rate curve 9 is referred to and the duty is 55% (P4) in this case, the brightness increase ratio (the duty increase ratio) for the duty of 36.5% (P3) of the LED at the time when all the LEDs are lit up is about 1.5 and, therefore, the second brightness can be acquired for each area by multiplying the first brightness by 1.5. In the case where it is determined that the ambient luminance is low, when the brightness to lighting rate curve 11 is referred to based on the same lighting rate (53%) and the duty is 40% in this case, the brightness decrease ratio (the duty decrease ratio) for the duty of 55% (P4) is about 0.73 and, therefore, the third brightness can be acquired for each area by multiplying the second brightness by this 0.73.

Though the brightness decrease ratio (the duty decrease ratio) is acquired based on the brightness to lighting rate curves 9 and 11 in the above example, the brightness increase ratio (the duty increase ratio) may directly be acquired from the brightness to lighting rate curve 11. In the case where it is determined that the ambient luminance is low and the lighting rate of the LED backlight 5 is 53%, when the brightness to lighting rate curve 11 is referred to without referring to the brightness to lighting rate curve 9 and the duty is 40% in this case, the brightness increase ratio (the duty increase ratio) for the duty of 36.5% (P3) of the LED acquired when all the LEDs are lit up is about 1.1 and, therefore, the third brightness can consequently be acquired that is acquired by decreasing the second brightness similarly to the above example by multiplying the first brightness by 1.1.

Figure 7:
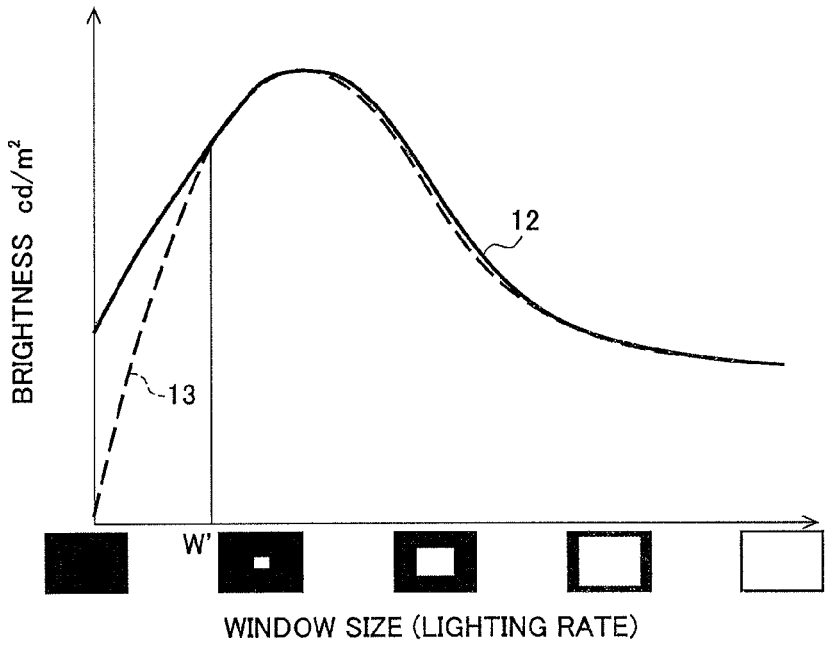
FIG. 7 is a diagram of another example of the brightness to lighting rate curve.
Figure 7:
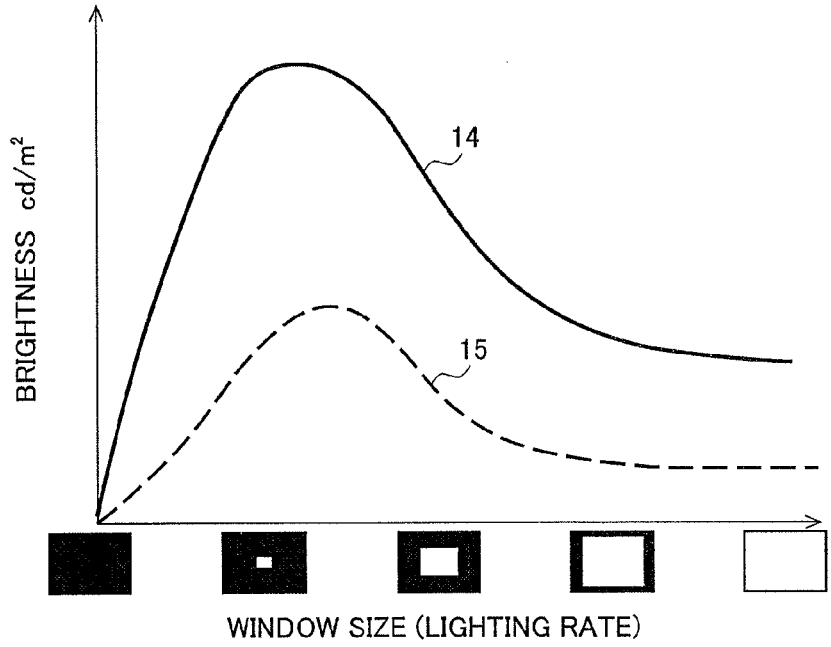

FIG. 7 is a diagram of another example of the brightness to lighting rate curve. In (A) of FIG. 7, a brightness to lighting rate curve 12 is used in a light environment and a brightness to lighting rate curve 13 is used in a dark environment. In the example of (A) of FIG. 7, when the lighting rate of the LED backlight 5 is equal to or lower than the predetermined value W (<the predetermined value W of FIG. 6), the control is executed such that the brightness of the LED in the dark environment is lower than that in the light environment. In (B) of FIG. 7, a brightness to lighting rate curve 14 is used in the light environment and a brightness to lighting rate curve 15 is used in the dark environment. In the example of (B) of FIG. 7, the control is executed for all the lighting rates of the LED backlight 5 such that the brightness of the LED in the dark environment is lower than that in the light environment.

As above, when the backlight is divided into the plural areas and the brightness of the backlight is controlled depending on the video signal corresponding to each area: the contrast can be increased by increasing the brightness ratios among the areas; the peak brightness can be increased by locally supplying the electric power when the area for the backlight to be lit up is small; and the peak brightness can be reduced depending on the illuminance around the video display apparatus. Therefore, any light leakage and any black float can be reduced maintaining the impression of the high contrast when the ambient luminance is low.

Figure 8:
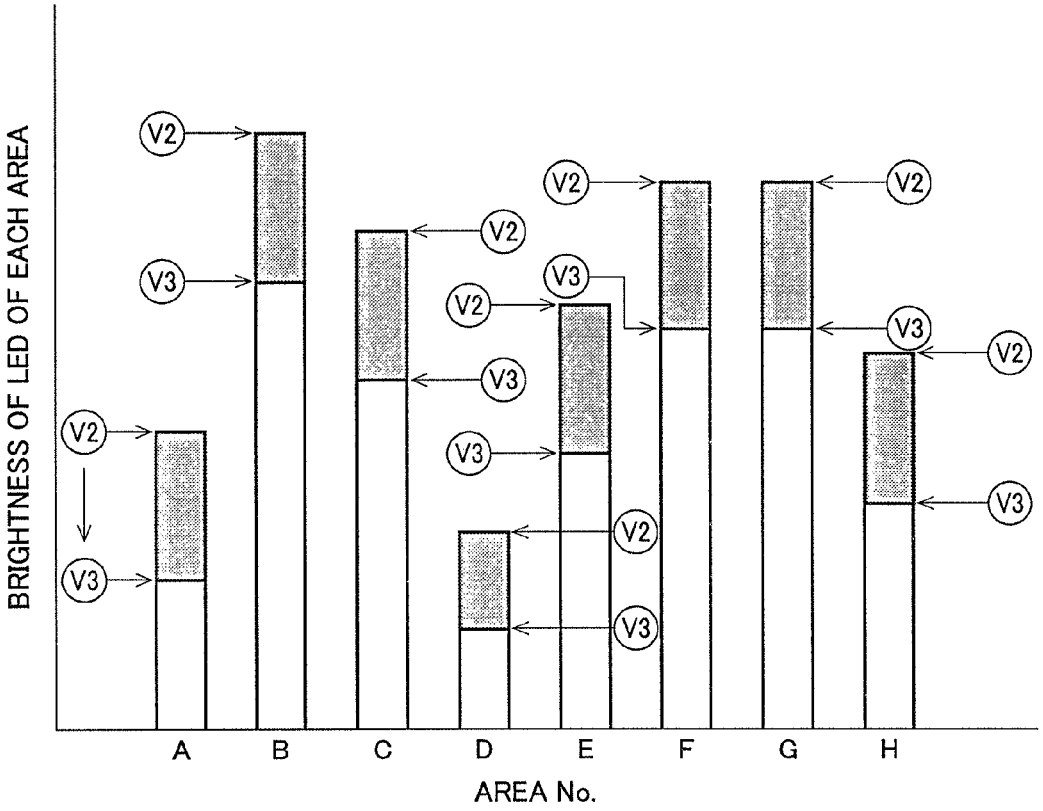
FIG. 8 is a diagram of the state where the areas depicted in FIG. 5 are arranged in order of area No.

FIG. 8 is a diagram of the state where the areas depicted in FIG. 5 are arranged in order of area No. The axis of abscissa represents the area No., and the axis of ordinate represents the brightness value of the LED in each area. The brightness value of the LED can be represented by, for example, the gray scale values from zero to 255 (the LED gray scale levels). First, the brightness value of the LED for each area is determined using the conventional local dimming approach. It is assumed that this brightness is the first brightness. As depicted in (B) of FIG. 9, the first brightness is determined to be relatively low in an area where maximal gray scale value of the video signal is small, and is determined to be relatively high in an area where maximal gray scale value of the video signal is large. Thereby, similarly to the conventional case, any black float is prevented in the low gray scale level areas; the contrast is improved; reduction of the power consumption is provided; and a brilliancy feeling is enhanced by increasing the brightness in the high gray scale level areas. The brightness of the LED in each area in this case is set not to exceed the screen brightness (for example, 450 cd/m$^2$) at the time when all the LEDs are lit up.

The brightness value of the LED in each area is multiplied by the brightness increase amount calculated by the electric power limit control (for example, 150%). In this example, the value of the brightness increase amount is uniformly multiplied for all the areas. In the example of FIG. 6, the duty of the LED at the time when all the LEDs are lit up is 36.5%. However, for the lighting rate of 53%, the brightness of the LED is increased up to that for the duty of 55%. The brightness value acquired by multiplying the first brightness by 1.5 corresponds to the second brightness (V2) of FIG. 8.

When the lighting rate of the LED backlight 5 is equal to or lower than the predetermined value W, the third brightness (V3) of FIG. 8 is determined by reducing the second brightness (V2) depending on the ambient illuminance detected by the photosensor 8. When the ambient illuminance detected by the photosensor 8 exceeds the specific value and the ambient luminance is high, the light emission of the LED backlight 5 is controlled for each area based on the second brightness (V2) When the ambient illuminance detected by the photosensor 8 is equal to or lower than the specific value and the ambient luminance is low, the light emission of the LED backlight 5 is controlled for each area based on the third brightness (V3) acquired by reducing the second brightness (V2). The method of determining the third brightness (V3) is the same as described above and, therefore, will not again be described.

The example using the lighting rate of the LED backlight 5 has been described. However, the same control can also be executed using the APL of the video signal. The "APL" is the average value of the brightness of the overall video signal and, therefore, it is considered that the relation between the APL and the brightness of the LEDs of the divided area presents the same tendency as that of the brightness to lighting rate curve 9 depicted in FIG. 2. When the APL of the video signal is low, the lighting rate of the LED backlight 5 is also low and, when the APL of the video signal is high, the lighting rate of the LED backlight 5 is also high. Therefore, even when the axis of abscissa of FIG. 2 is caused to represent the APL, the same control can be executed.

EXPLANATIONS OF LETTERS OR NUMERALS

1 . . . image processing portion, 2 . . . area active control portion,
3 . . . LED control portion, 4 . . . LED driver, 5 . . . LED backlight,
6 . . . liquid crystal control portion, 7 . . . liquid crystal panel, 8 . . . photosensor

The invention claimed is:

1. A video display apparatus comprising: a display panel that displays a video signal; a backlight that uses LEDs as a light source illuminating the display panel; a control portion that controls a light emission brightness of the backlight; and an ambient illuminance detecting portion that detects ambient illuminance, the control portion dividing the backlight into a plurality of areas and controlling light emission of the LEDs for each of the divided areas, wherein the control portion acquires a first brightness of the LEDs for each area depending on a first feature value of the video signal of a display area corresponding to the divided area, acquires a second brightness for each area by uniformly multiplying the first brightness by a specific multiplying factor acquired depending on a lighting rate of the backlight or a second feature value of the video signal, within a range where a total value of driving currents of the LEDs is equal to or lower than a predetermined permissible current value, and acquires a third brightness by reducing the second brightness, when an ambient illuminance detected by the ambient illuminance detecting portion is equal to or lower than a specific value, based on the lighting rate of the backlight or the second feature value of the video signal that is equal to or lower than a predetermined value.

2. The video display apparatus as defined in claim 1, wherein the video display apparatus has therein a brightness curve that determines a relation between the lighting rate of the backlight or the second feature value of the video signal, and maximal display brightness capable of being taken on a screen of the display panel correlated in advance with the lighting rate of the backlight or the second feature value of the video signal, and wherein the predetermined value is set to be equal to or higher than the lighting rate of the backlight or the second feature value of the video signal for the maximal display brightness for a duty of 100% taken on the brightness curve.

3. The video display apparatus as defined in claim 1, wherein the control portion controls light emission of the LEDs for each area based on the second brightness when the ambient illuminance is higher than a specific value, and controls the light emission of the LEDs for each area based on the third brightness when the ambient illuminance is equal to or lower than a specific value.

4. The video display apparatus as defined in claim 1, wherein the first feature value is a maximal gray scale value of a video signal in the divided area.

5. The video display apparatus as defined in claim 1, wherein the second feature value is an APL of the video signal.

* * * * *